US006106661A

United States Patent [19]

Raeder et al.

[11] Patent Number: 6,106,661

[45] Date of Patent: Aug. 22, 2000

[54] POLISHING PAD HAVING A WEAR LEVEL INDICATOR AND SYSTEM USING THE SAME

[75] Inventors: Christopher H. Raeder; Kevin D. Shipley; Peter A. Burke, all of Austin, Tex.

[73] Assignee: Advanced Micro Devices, Inc., Austin, Tex.

[21] Appl. No.: 09/074,892

[22] Filed: May 8, 1998

[51] Int. Cl.[7] ..... C23F 1/02

[52] U.S. Cl. ..... 156/345; 438/691; 451/259

[58] Field of Search ..... 156/345; 451/259; 438/691

[56] References Cited

U.S. PATENT DOCUMENTS 5,913,713 6/1999 Cheek et al. ..... 451/41

*Primary Examiner*—Robert Dawson

*Assistant Examiner*—D. Aylward

*Attorney, Agent, or Firm*—Williams, Morgan & Amerson, P.C.

[57] ABSTRACT

A polishing pad having a wear level indicator and a polishing system employing the same is provided. A polishing pad, in accordance with one embodiment of the invention, includes a pad structure and an indicator, disposed in the pad structure, indicating the wear level of the pad structure. The pad structure may, for example, include a top pad and a bottom pad with the indicator being disposed in the top pad. The wear level may, for example, be a critical thickness of the polishing pad which indicates the end of the pad lifetime or which indicates the need to change polishing processing. The use of a wear level indicator allows for efficient and reliable pad wear level indication.

42 Claims, 3 Drawing Sheets

POLISHING PAD HAVING A WEAR LEVEL INDICATOR AND SYSTEM USING THE SAME

FIELD OF THE INVENTION

The present invention relates generally to the planarization of semiconductor wafers and, more specifically to a polishing pad having a wear level indicator and a system using the same.

BACKGROUND OF THE INVENTION

Chemical-mechanical polishing (CMP) is a widely used means of planarizing silicon dioxide as well as other types of surfaces on semiconductor wafers. Chemical mechanical polishing typically utilizes an abrasive slurry disbursed in an alkaline or acidic solution to planarize the surface of the wafer through a combination of mechanical and chemical action.

One type of chemical mechanical polishing system has a rotatable circular platen or table on which a polishing pad is mounted. A multi-head polishing device is positioned above the table. The polishing device has multiple rotating carrier heads to which wafers can be secured typically through the use of vacuum pressure. In use, the platen is rotated and an abrasive slurry is disbursed onto the polishing pad of the platen. Once the slurry has been applied to the polishing pad, the rotating carrier heads move downward to press their corresponding wafers against the polishing pad. As the wafer is pressed against the polishing pad, the surface of the wafer is mechanically and chemically polished.

FIG. 1 illustrates a typical polishing pad 120 shown mounted on a platen 110. The polishing pad 120 includes a bottom pad 122 mounted on the platen and a top pad 124 mounted on the bottom pad. Typically, the top pad 124 is adhered to the bottom pad 122 using a glue. The bottom pad 122 serves as a damper and typically is formed from foam or felt. The top pad 124 generally contacts the wafer for polishing and is typically formed from polyurethane.

Polishing pads, such as the one described above, are engineered in an effort to maximize their planarization efficiency. Simultaneously, efficient, extended use of the pads generally requires pad conditioning between polishing runs. Conditioning typically includes applying a conditioning tool, such as a diamond impregnated steel plate, to the top pad to remove expired surface and expose fresh pad material. Repeated conditioning leads to thinning of the pad, a resultant decrease in the planarization efficiency and eventual end of useful pad life.

At present, a variety of methodologies are used to determine the appropriate time for a pad change. These include: number of wafers polished, number of pad condition hours, direct measurements of pad thickness. The first two methods are easily employed but prone to error due to the indirect nature of the measurements. The third method is inconvenient and labor intensive.

SUMMARY OF THE INVENTION

The present invention generally provides a polishing pad having a wear level indicator and a polishing system employing the same. The use of a wear level indicator allows for more efficient and reliable pad wear level indication than present methods. A polishing pad, in accordance with one embodiment of the invention, includes a pad structure and an indicator, disposed in the pad structure, indicating the wear level of the pad structure. The pad structure may, for example, include a top pad and a bottom pad with the indicator being disposed in the top pad. The wear level may, for example, be a critical thickness of the polishing pad which indicates the end of the pad lifetime or which indicates the need to change polishing processing.

The above summary of the present invention is not intended to describe each illustrated embodiment or implementation of the present invention. The Figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
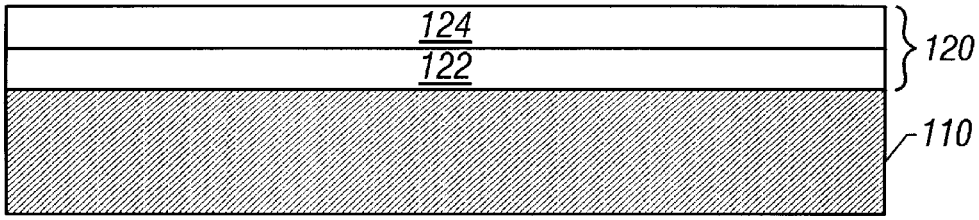
FIG. 1 (Prior Art)
FIG. 1 is a cross-sectional view of a conventional polishing pad.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a number of types of polishing systems which employ polishing pads. The invention has been found to be particularly advantageous in indicating the wear level of polishing pads used in chemical-mechanical polishing. While the present invention is not so limited, an appreciation of various aspects of the invention will be gained through the discussion below.

FIGS. 2–9 illustrate exemplary polishing structures each having a polishing pad with a wear level indicator in accordance with an embodiment of the invention. By way of example, each illustrated polishing pad includes a dual-pad structure and is shown with a polish platen. In particular, the exemplary polishing pads each include a top pad in which a wear level indicator is disposed and a bottom pad which lies between the top pad and the polish platen. With the exception of the wear level indicator, the polishing pads and structures can, for example, be manufactured using well-known techniques such as those used to form the conventional polishing structure of FIG. 1. For example, the top pads and bottom pads may be held together using an adhesive, such as glue. It is stressed, however, that the various polishing structures and pads discussed below are provided by way of example and not of limitation. The invention is applicable to any type structure having a polishing pad which is conditioned. For instance, polishing pads formed from any number of pads, including a single pad, are within the scope of the invention.

Figure 2:
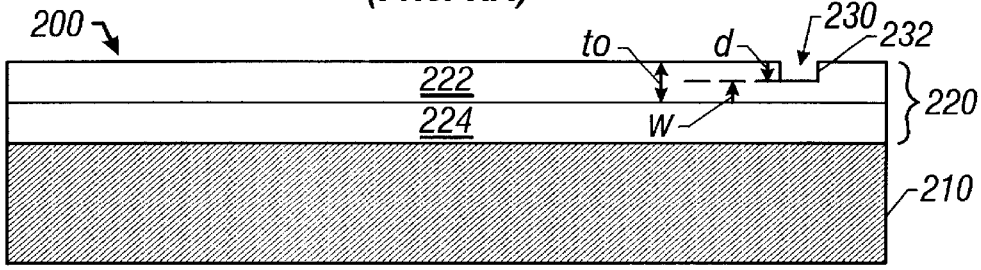
FIGS. 2–9 illustrate exemplary polishing pads in accordance with various embodiments of the invention.

FIG. 2 illustrates an exemplary polishing structure in accordance with one embodiment of the invention. The polishing structure 200 generally includes a polish platen 210 on which a polishing pad 220 having top pad 222 with a wear level indicator 230 is mounted. In this particular embodiment, the wear level indicator 230 is a trench 232, the depth d of which is set to indicate a predetermined wear level w of the polishing pad 220. The trench 232 may be manufactured using a number of different techniques. The trench 232 may, for example, simply be formed by cutting out a portion of the top pad 222 to the desired depth. This may be done before or after the top pad 222 and bottom pad 224 are adhered together.

In operation, as the polishing pad 220 is conditioned, the thickness of the top pad 222 as well as the depth of the trench 232 will be reduced. Upon sufficient conditioning, the trench 232 will disappear, thereby indicating that the polishing pad 220 has reached its predetermined wear level w. The wear level w typically corresponds to a critical thickness of the pad, such as, for example, a thickness of the pad at which the pad has reached the end of its useful life or at which the polishing process must be changed based on the pad thickness. The wear level w can vary depending on, for example, the type of pad material and the polishing process used. Suitable wear levels w range from about 30% to 60% of the initial top pad thickness $t_o$ for many applications. Accordingly, suitable trench depths d range from about 0.7 to 0.4 $t_o$.

Figure 3:
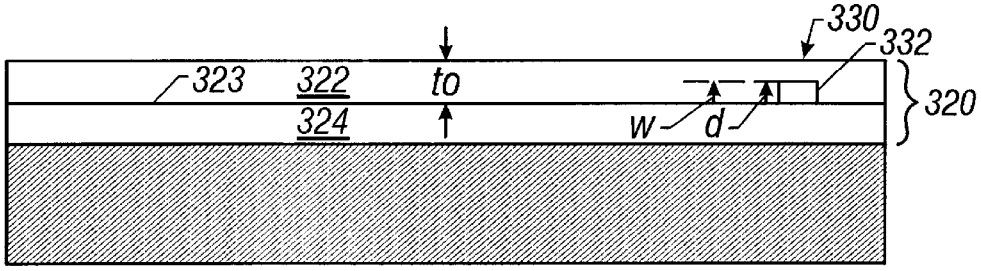

FIG. 3 illustrates another embodiment of the invention in which a top pad 322 of a polishing pad 320 is provided with an inverted trench 332 as a wear level indicator 330. In this particular embodiment, the trench 332 is cut out of the bottom surface 323 of the top pad 322, typically prior to adhering the top pad 322 to the bottom pad 324. In use, upon sufficient conditioning of the top pad 322, the trench 332 will appear, thereby indicating the wear level of the polishing pad 320. The depth d of the trench 332 is suitably selected in consideration of the desired wear level w of the top pad 332. As indicated above, for many applications, the desired wear level w and thus the trench depth d ranges from about 30% to 60% of the initial top pad thickness to.

Figure 4:
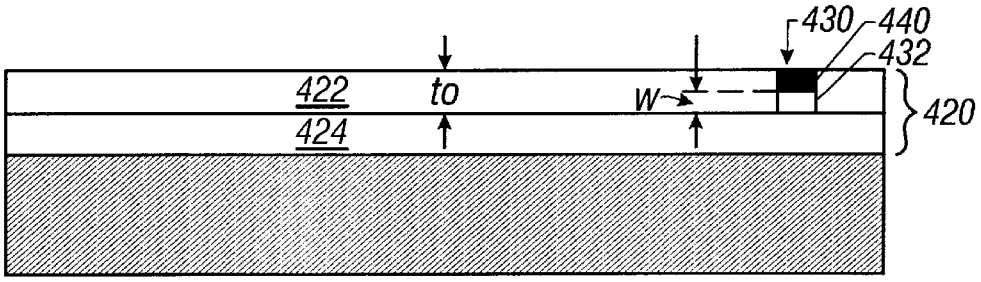
Figure 5:
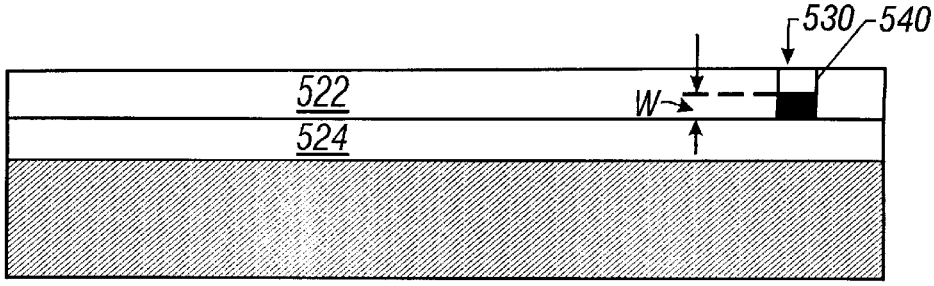

FIGS. 4 and 5 illustrate exemplary embodiments of the invention in which color inserts 432/532 are used as wear level indicators 430/530 of a polishing pad. In FIG. 4, the top pad 422 of the polishing pad 420 includes a through-hole 440 in which a color insert 432 is disposed. The color insert 432 includes a lower portion 434 of one color and an upper portion 436 of a different color. In the illustrated embodiment, the lower portion 434 has a similar color as the bulk of the top polishing pad 422, while the upper portion 436 has a readily distinguishable color. In use, the disappearance of the upper portion color and/or the appearance of the lower portion color indicates the desired wear level w of the top pad 422. The interface 433 of the upper and lower portions 434 and 436 is typically set to the desired wear level w of the polishing pad 420, and, depending on the application, may be located at about 30% to 60% of the initial thickness to of the top pad 422.

The top pad 522 of FIG. 5, similar to that of FIG. 4, includes a through-hole 540 in which a color insert 532 is disposed. In this embodiment, the upper portion 534 has a similar color as the bulk of the polishing pad 522, while the lower portion 536 has a readily distinguishable color. In use, the appearance of the lower portion color indicates the desired wear level w of the pad 522. Alternatively, the lower portion 524 may include a dye cartridge which burst when subject to conditioning and spreads color dye over the top pad 522 to indicate attainment of the wear level w.

The color wear level inserts 432/532 may be formed from a number of different materials including, for example, polyurethane or felt. Typically, the color insert 532/432 is provided with an unstressed cross-sectional area slightly larger than the cross-sectional area of the hole 540/440 such that when inserted into the hole 40/440, the color insert 532/432 is retained therein. The glue adhering the two pads 22/422 and 524/424 may also provide retention for the insert 532/432. The hole 540/440 may, for example, be punched through the top pad 522/422 prior to adhering the top pad 522/422 to the bottom pad 524/424.

Figure 6:
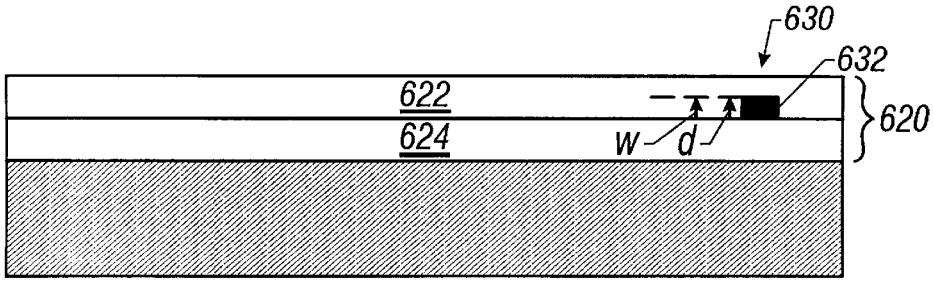
Figure 7:
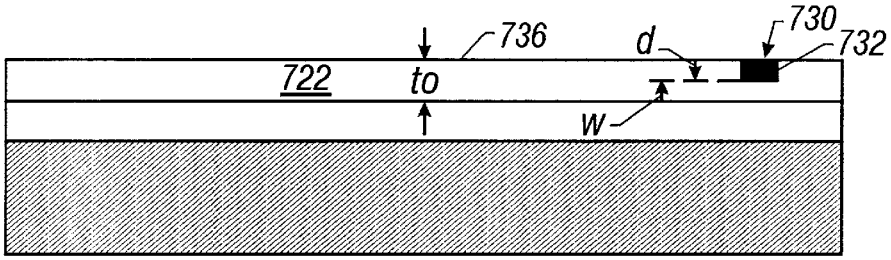

FIGS. 6 and 7 illustrate embodiments of the invention in which partial color inserts 632/732 are used as wear level indicators 630/730 for a polishing pad. In FIG. 6, a partial color insert 632 is disposed within a top pad 622 of a polishing pad 620. The partial color insert 632 typically has a color which is readily distinguishable from the bulk of the top pad 622 and, in addition, typically has a depth d corresponding to the desired wear level w of the polishing pad, as discussed above. In use, upon sufficient conditioning of the top pad 622, the color insert 632 will appear, indicating the particular wear level w of the polishing pad 620. The color insert 632 may be provided using a number of different techniques. For example, the color insert 632 may be provided in the top pad 622 by cutting away part of the pad 622 and inserting the color insert 632 within the cutout trench. The color insert 632 may, for example, be formed from polyurethane and held within the trench by way of a snug fit (e.g., by providing the color insert 632 with an unstressed cross-sectional area greater than the cutout trench) as well as the glue between the top and bottom pads 622 and 624. In an alternate embodiment, the color insert 632 may be a dye cartridge which bursts when subject to conditioning, thereby discoloring a large area of the pad and readily indicating the wear level w.

In FIG. 7, a color insert 732 is provided in a trench 734 cut out of the top surface 736 of the polishing pad 722. The partial color insert 732 may, for example, have a depth d (e.g., 40% to 70% of initial pad thickness to) equivalent to the desired wear level w, as discussed above. In use, upon sufficient conditioning, the color insert 732 will be removed and upon the absence of its color, the pad 722 will indicate its particular wear level w. The color insert 732 may, for example, be formed from polyurethane or felt and have an unstressed cross-sectional area slightly larger than the cutout trench 734. This enables the partial color insert 732 to be held within the pad 722 by tightness of fit.

Figure 8:
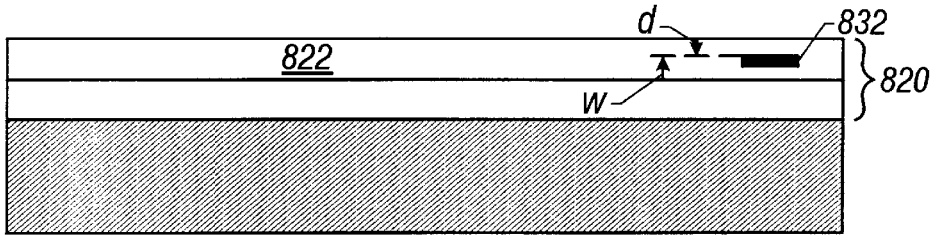

FIG. 8 illustrates an embodiment of the invention in which a color insert 832 functioning as a wear level indicator is embedded within a top pad 822 of a polishing pad 820 at a depth d equivalent to a desired wear level w. Typically, the color insert 832 is provided within the top pad 822 at the time of manufacturing to prevent localized thickness variation. For example, the top pad 822 may be formed from a polyurethane using a curing process. During the curing process, while the top pad 822 is still relatively flowable, the color insert 832 may be inserted into the polyurethane. In another embodiment, rather than using color insert 832, the top pad 822 may be colored itself. This may be done, e.g., by simply coloring a polyurethane top pad 822 during the manufacturing process.

Figure 9:
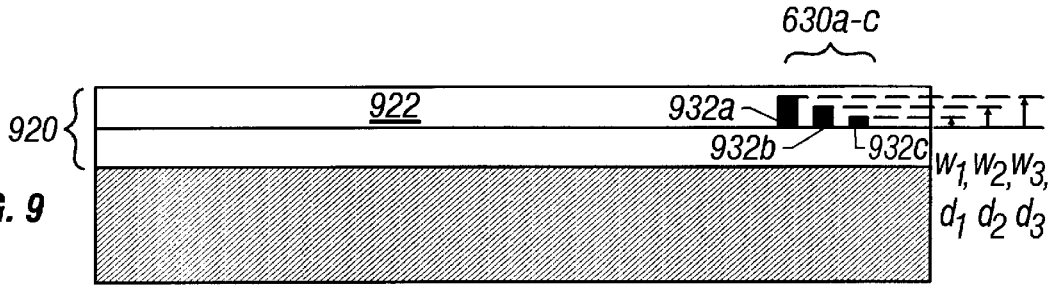

FIG. 9 illustrates an exemplary polishing pad having a series of graded indicators 930*a–c* indicating different wear levels $w_1 \ldots w_3$. In this particular embodiment, partial color inserts 932*a–c*, e.g., similar to the color insert discussed above with respect to FIG. 6, are provided having different depths $d_1 \ldots d_3$ relative to the top pad 922 of the polishing pad 920. As the polishing pad is conditioned, the color inserts 932*a–c* will appear at their set thicknesses $d_1 \ldots d_3$ to indicate the corresponding wear levels $w_1 \ldots w_3$. This provides an efficient way for indicating different thicknesses of the polishing pad 920. The first two graded indicators 932*a* and *b* may, for example, be used to identify wear levels at which the polishing process must be changed. For example, at particular wear levels $w_1 \ldots w_2$ different parameters of the polishing process (e.g., length of time, slurry mix, wafer placement, etc.) may need adjusting. The final indicator 932*c* may, for example, then be used to indicate a wear level $w_3$ corresponding to the pad end of lifetime. While the graded indicators are illustrated through the use of a partial color insert similar to that of FIG. 6, it should be appreciated that any combination of the aforementioned wear level indicators may be used to provide a graded indication scheme.

The wear level indicators illustrated above may be located at any of a number of positions in a polishing pad. Typically, the wear level indicators are located at a positions which have little or no effect on the polishing process. Suitable locations include, for example, areas of the polishing pad which remain unused throughout the polishing pad lifetime. Moreover, while only one wear level indicator or set of graded indicators is shown in each embodiment, it should be appreciated that additional wear level indicators or sets thereof may be placed about a polishing pad if desired. The use of multiple wear level indicators can, for example, increase the ability to detect localized regions of pad wear level.

Figure 10A:
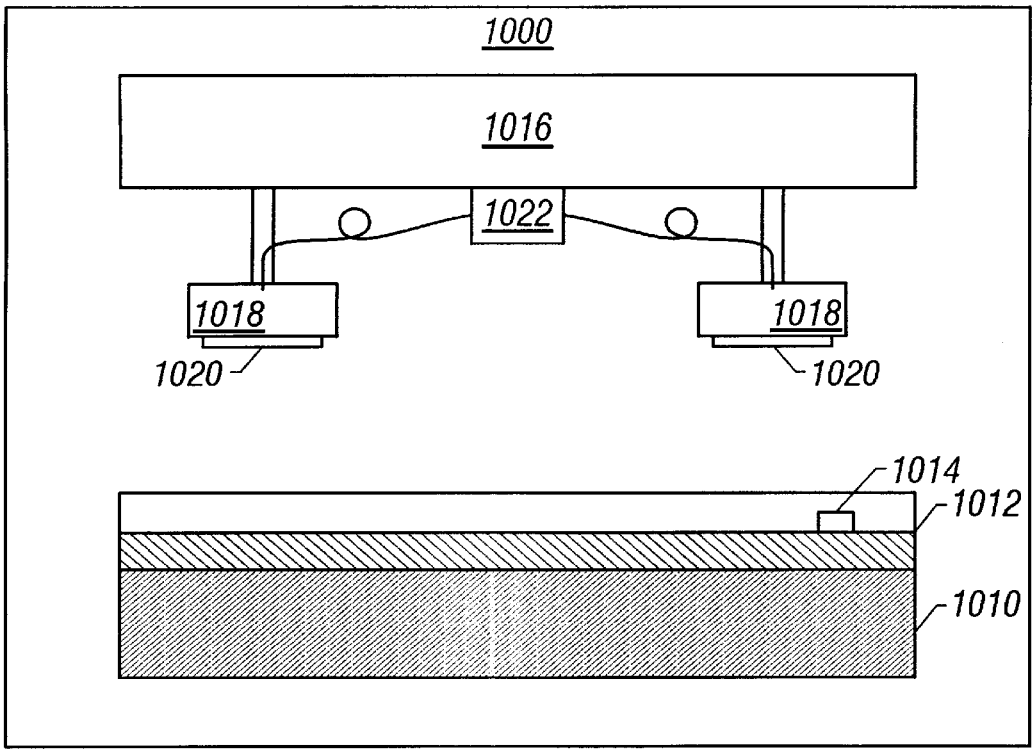
FIG. 10 illustrates an exemplary polishing system incorporating a polishing pad in accordance with one embodiment of the invention.
Figure 10B:
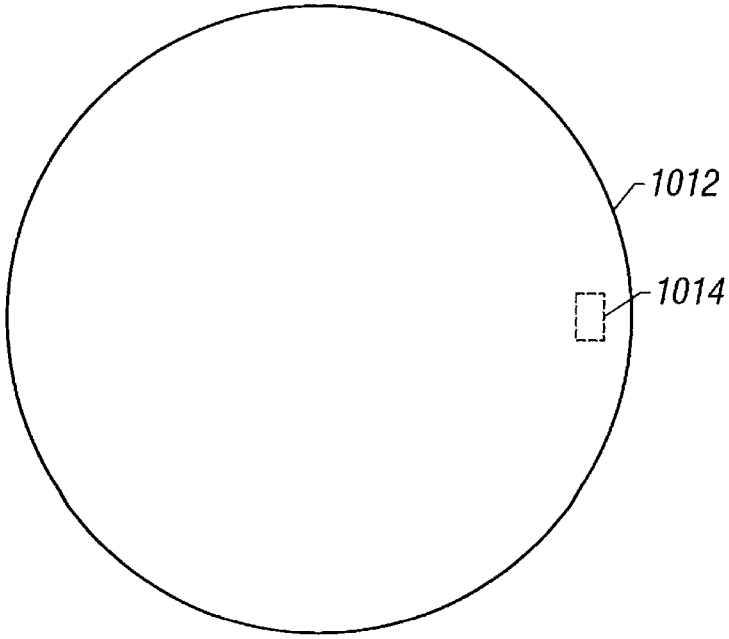

FIGS. 10A and 10B illustrate an exemplary chemical-mechanical polishing system having a polishing pad with a wear level indicator. The CMP polishing system 1000 generally includes a platen 1010 on which a polishing pad 1012 having a wear level indicator 1014 is mounted. By way of example, a wear level indicator similar to that disclosed in FIG. 4 is provided. However, it should appreciated, any of the various wear level indicators may be used with a polishing system. The illustrated CMP system 1000 further includes a multi-head carrier 1016 positioned above the platen 1010. The multi-head carrier 1016 includes a plurality of rotatable carrier heads 1018 on which semiconductor wafers 1020 can be secured using known techniques such as vacuum pressure. A source of polishing fluid 1022 is provided to supply polishing fluid to the pad 1012 for polishing While a multi-head chemical-mechanical polishing system is shown in the illustrative embodiment of FIG. 10, as noted above, any type of polishing system using a polishing pad subjected to conditioning may be employed.

As noted above, the present invention is applicable to fabrication of a number of different types of polishing systems which employ polishing pads and would benefit from a polishing pad wear level indicator. Accordingly, the present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art upon review of the present specification. The claims are intended to cover such modifications and devices.

What is claimed is:

1. A polishing pad, comprising:

a pad structure having a polishing surface; and a wear level indicator disposed in the pad structure for indicating a wear level of the pad structure, at least a portion of the wear level indicator being positioned adjacent the polishing surface.

2. The polishing pad of claim 1, wherein the wear level corresponds to a thickness of the pad structure signifying an end of pad life.

3. The polishing pad of claim 1, wherein the wear level corresponds to a thickness of the pad structure signifying a change in a polishing process.

4. The polishing pad of claim 1, further including one or more additional indicators disposed in the pad structure for indicating the wear level of the pad structure.

5. The polishing pad of claim 4, wherein the wear level indicators are disposed in the pad structure in a graded arrangement for indicating multiple wear levels of the pad structure.

6. The polishing pad of claim 1, wherein the pad structure inlcudes a top pad and a bottom pad, the top pad being mounted on the bottom pad, the bottom pad being mountable on a platen.

7. The polishing pad of claim 1, wherein the polishing structure includes a pad mountable on a platen.

8. The polishing pad of claim 1, wherein the indicator includes a trench having an open end that is positioned adjacent the polishing surface of the pad structure.

9. The polishing pad of claim 8, wherein the pad structure includes a top pad and a bottom pad, the trench being formed in the top pad.

10. The polishing pad of claim 1, wherein the indicator includes a material having a different color than a surrounding portion of the pad structure.

11. The polishing pad of claim 10, wherein the indicator is a portion of the pad structure having a different color than the surrounding portion of the pad structure.

12. The polishing pad of claim 10, wherein the indicator is an insert, the insert including the material having a different color than the surrounding portion of the pad structure.

13. The polishing pad of claim 12, wherein the differently colored material is disposed in a bottom portion of the insert away from the polishing surface of the pad structure.

14. The polishing pad of claim 12, wherein the differently colored material is disposed in a top portion of the insert adjacent the polishing surface of the pad structure.

15. The polishing pad of claim 12, wherein the pad structure includes a trench in which the differently colored material is disposed.

16. The polishing pad of claim 12, wherein the pad structure includes a top pad and a bottom pad, the insert being disposed in the top pad.

17. The polishing pad of claim 16, wherein the top pad defines a hole extending between the polishing surface and a bottom surface of the top pad, the insert being disposed within the hole.

18. The polishing pad of claim 17, wherein the insert adheres to an upper surface of the bottom pad.

19. The polishing pad of claim 16, wherein the top pad includes a trench in the polishing surface opposite the bottom pad, the insert being disposed in the trench.

20. The polishing pad of claim 19, wherein the insert is frictionally fit into the trench.

21. The polishing pad of claim 1, wherein the wear level indicator is a dye cartridge.

22. A system for polishing semiconductor wafers, comprising:

a polishing platen;

a motor for rotating the polishing platen;

a polishing pad mounted on the polishing platen, the polishing pad including an indicator disposed in the polishing pad for indicating a wear level of the polishing pad, at least a portion of the indicator being positioned adjacent a polishing surface of the polishing pad; and a source of polishing fluid adapted for providing polishing fluid to the polishing pad.

23. The polishing system of claim 22, wherein the polishing pad includes a top pad and a bottom pad, the indicator being disposed in the top pad.

24. The polishing system of claim 23, wherein the polishing pad further includes additional indicators disposed in the polishing pad for indicating the wear level of the pad structure.

25. The polishing system of claim 24, wherein the wear level indicators are disposed in the pad structure in a graded arrangement for indicating multiple wear levels of the polishing pad.

26. The polishing system of claim 24, wherein the wear level indicators are positioned in spaced apart locations of the polishing pad and a plurality of the wear level indicators have a similar grade for indicating a common wear level at the spaced apart locations of the polishing pad.

27. The polishing pad of claim 1, wherein the wear level indicators are positioned in spaced apart locations of the polishing pad and a plurality of the wear level indicators have a similar grade for indicating a common wear level at the spaced apart locations of the polishing pad.

28. A polishing pad, comprising:

a pad structure having a polishing surface; and at least one trench disposed in the polishing surface of the pad structure for indicating a wear level of the pad structure, the trench having an open end that is positioned adjacent the polishing surface.

29. The polishing pad of claim 28, wherein the at least one trench has a depth that corresponds with a predetermined wear level of the polishing pad.

30. The polishing pad of claim 28, wherein the pad structure includes a top pad and a bottom pad, the top pad being mounted on the bottom pad, the bottom pad being mountable on a platen.

31. The polishing pad of claim 28, wherein a plurality of trenches are disposed in the polishing surface of the polishing pad, and the plurality of trenches have varied depths for indicating multiple wear levels of the polishing pad.

32. The polishing pad of claim 28, wherein a plurality of trenches are disposed in spaced apart locations of the polishing surface of the polishing pad, the plurality of trenches having a similar depth for indicating a common wear level at the spaced apart locations of the polishing pad.

33. A polishing pad, comprising:

a pad structure having a polishing surface; and at least one insert disposed in the pad structure for indicating a wear level of the pad structure, at least a portion of the at least one insert having a different color than a surrounding portion of the pad structure, and at least a portion of the at least one insert being positioned adjacent the polishing surface.

34. The polishing pad of claim 33, wherein the differently colored portion of the at least one insert is positioned in a bottom portion of the insert away from the polishing surface of the pad structure.

35. The polishing pad of claim 34, wherein the differently colored portion of the at least one insert represents a predetermined wear level of the pad structure.

36. The polishing pad of claim 33, wherein the differently colored portion of the at least one insert is positioned in a top portion of the insert adjacent the polishing surface of the pad structure.

37. The polishing pad of claim 36, wherein at least a portion of the at least one insert has a color that is similar to the surrounding portion of the pad structure, and the similarly colored portion of the at least one insert represents a predetermined wear level of the pad structure.

38. The polishing pad of claim 33, wherein a plurality of the inserts are disposed in the polishing pad, and the differently colored portions of the plurality of inserts are located in different positions on the inserts for indicating multiple wear levels of the polishing pad.

39. The polishing pad of claim 33, wherein a plurality of the inserts are disposed in different locations of the polishing pad, and the differently colored portions of the plurality of inserts are located in similar positions on the inserts for indicating a common wear level at the different locations of the polishing pad.

40. A method comprising:

conditioning a polishing pad having a wear level indicator disposed therein, at least a portion of the wear level indicator being positioned adjacent a polishing surface of the polishing pad; and determining a wear level of the polishing pad based on changes in the wear level indicator.

41. The method of claim 40, further comprising replacing the polishing pad with a new polishing pad once the wear level of the polishing pad has increased beyond a predetermined threshold.

42. The method of claim 40, further comprising adjusting a processing parameter of a polishing process based on a predetermined wear level of the polishing pad.

* * * * *